US009328983B2

(12) United States Patent
Wilkinson

(10) Patent No.: US 9,328,983 B2
(45) Date of Patent: May 3, 2016

(54) SPECIAL TOOL DEVICE FOR EASY DISASSEMBLY AND REASSEMBLY FOR CLEANING AN AUTOMATIC PISTOL SUCH AS A RUGER

(71) Applicant: Steve Wilkinson, Anderson, IN (US)

(72) Inventor: Steve Wilkinson, Anderson, IN (US)

( * ) Notice: Subject to any disclaimer, the term of this patent is extended or adjusted under 35 U.S.C. 154(b) by 0 days.

(21) Appl. No.: 14/534,135

(22) Filed: Nov. 5, 2014

(65) Prior Publication Data

US 2015/0121742 A1 May 7, 2015

Related U.S. Application Data

(60) Provisional application No. 61/900,524, filed on Nov. 6, 2013.

(51) Int. Cl.

| | |
|---|---|
| ***F41C 27/00*** | (2006.01) |
| ***F41A 11/00*** | (2006.01) |
| *F41A 29/00* | (2006.01) |

(52) U.S. Cl.
CPC *F41A 11/00* (2013.01); *F41A 29/00* (2013.01)

(58) Field of Classification Search
CPC ..... F41C 27/00
USPC ..... 42/108
See application file for complete search history.

(56) References Cited

U.S. PATENT DOCUMENTS

| | | | | |
|---|---|---|---|---|
| 6,230,430 | B1 | 5/2001 | Gosselin | |
| D548,552 | S | 8/2007 | Elkaim | |
| 7,644,529 | B2 | 1/2010 | Hopper et al. | |
| 8,793,919 | B1 * | 8/2014 | Probst, Jr. | F41C 27/00 42/108 |
| 2012/0005937 | A1 * | 1/2012 | Milino | F41A 23/18 42/108 |

* cited by examiner

*Primary Examiner* — Reginald Tillman, Jr.
(74) *Attorney, Agent, or Firm* — John D Ritchison

(57) ABSTRACT

A tool device for easy cleaning of an automatic Pistol such as a Ruger Mark Series. It relates to a method and tool for disassembling and reassembling automatic pistol components including removing a mainspring assembly, bolt, spring assembly, barrel and grips. It is useful for cleaning, inspection and replacement of parts for handguns. It is a one piece handgun disassembly and reassembling tool made of a durable material and configured for use with a handgun, the tool having a guide rod/rib with a key and an aperture, an angled section of a rib, and other features to facilitate disassembly, cleaning, reassembly of the automatic weapon and reloading magazines.

7 Claims, 17 Drawing Sheets

Shown without guides

Shown without guides

Shown without guides

Shown without guides

Shown without guides

Shown without guides

Shown without guides

Shown without guides

Shown without guides

Shown without guides

Shown without guides

Instructions for disassembling and assembling the Mark Series Pistol with all in-one-tool.

It is important to read the instructions carefully and then look at each sketch before attempting each step.
Getting a step wrong or not putting the gun in a certain position can cause the gun to be jammed.
Safety is always the first priority. No ammunition should be in the firearm or at the work area. The stand, included in the kit option, will free the second hand making the process safer and easier for new pistol owners

Disassembling the gun. 90

Step 1 - 91

Open bolt safety check:. Do safety check to ensure no ammunition is in the Gun. Furthermore, make sure ammunition is not in one's work area.

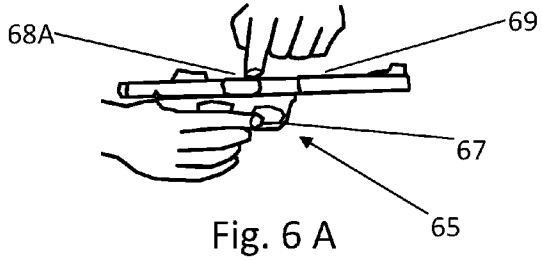

Fig. 6 A

Step 2 - 92

Dry fire Pistol: Point gun in a safe direction and pull the trigger, dry firing the gun. Make sure pistol is un-cocked before proceeding to step 3

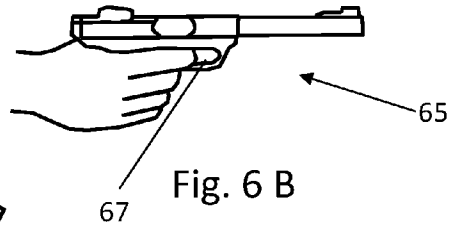

Fig. 6 B

Step 3 - 93

Remove clip/magazine:

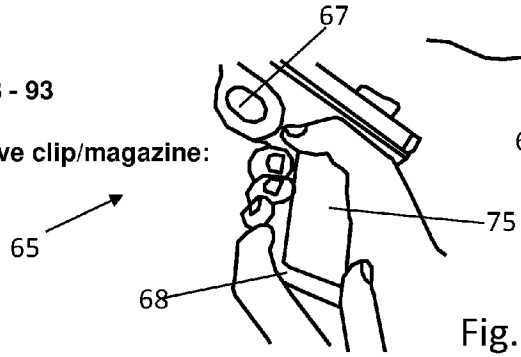

Fig. 6 C

Step 4 - 94

Inserting key into groove: Insert key hole point of tool into the top of the groove in mainspring slot in the pistol grips frame, over latch of mainspring. The tool will be at a downward angle. Press key

Step 5 - 95

Open mainspring latch: Pull tool in a downward direction inserting key hole though latch. This will pull the mainspring latch out.

Step 6 - 97

Removing the mainspring pin assembly. The mainspring pin is located directly behind the rear site of the pistol.

Option A) new or excessively dirty guns. Option B) broken in guns. There are two options to step 7, choose the one that works best for you.

Option A) New guns: For new or excessively dirty pistols it may be required to use both hands to start pin, located behind rear site. Put pistol in the stand to free second hand Fig. 6 F, to put more pressure on the tool. (Two options see Fig. 6 G and 6 H) Either use the 45 on the dowel or the block of the tool to start the pin out, Fig. 6 G . In extreme cases, a few light taps with a hammer onto the block of the tool may be needed to start pin removal, use 3 Fig. 6 H to set block over pin, if hammering is required. Once the pin is started line dowel of tool straight over pin, one can also use two hands, or a hammer, to press the mainspring pin fully out, by pressing the dowel of the tool through the hole in the gun barrel. (In the fourth sketch Fig. 6 I below one can see the round dowel pin of the mainspring laying on the table.) If after dowel of tool is fully in, and mainspring is not out remove by hand.

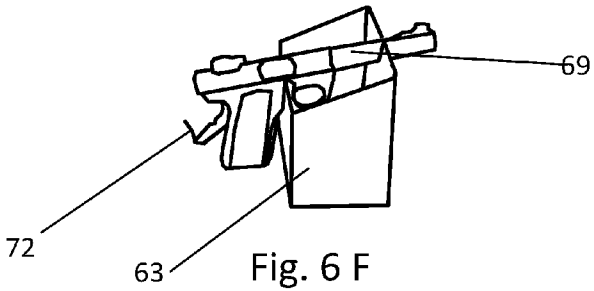

Fig. 6 F

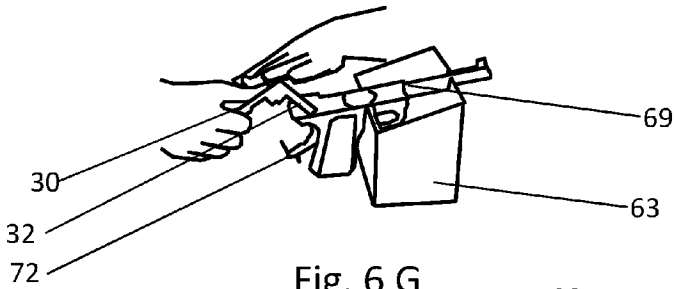

Fig. 6 G

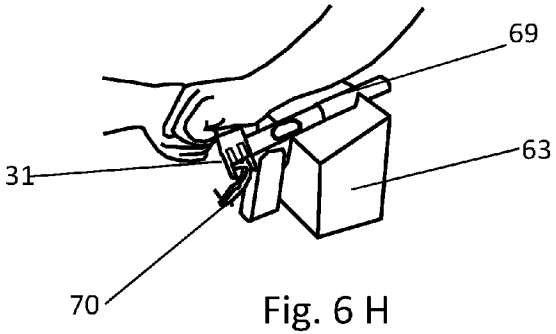

Fig. 6 H

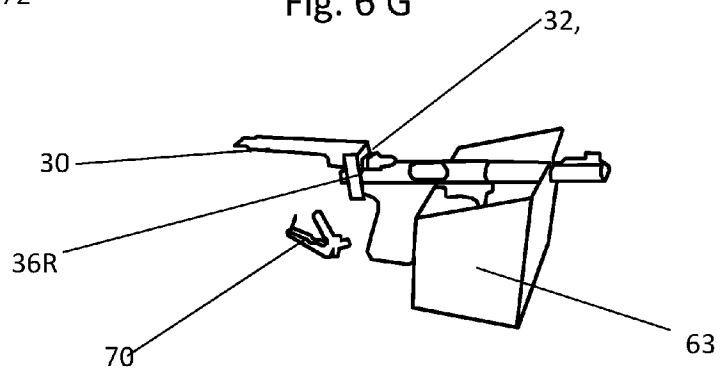

Fig. 6 I

Step 6 Continued Removing mainspring - 97

There are two options to step 7, choose the one that works best for you.

Option B) Broken in or used pistols: Once the pistol has been disassembled a few times it is easier to take apart, unless one allow the pistol to become extremely dirty. If firearm is excessively dirty, use above step with stand. Now one pries the dowel to pry pin out: Place the 45 degree angle of the end of the dowel pin of the tool over top of the dimple of the mainspring pin. Then pry like a can opener down until the mainspring pin pushed below surface of barrel. Next line dowel of tool straight over mainspring pin. Then push mainspring pin out. If dowel of tool is fully in and mainspring pin did not completely come out, remove by hand.

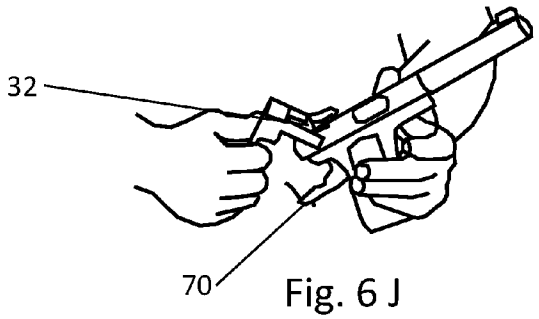

Fig. 6 J

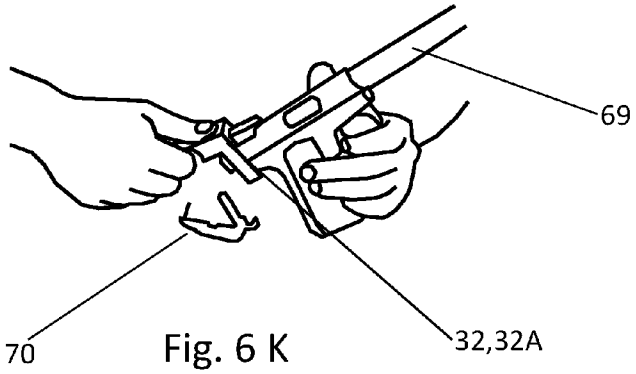

Fig. 6 K

Step 7 - 98

Pull bolt out of gun: If bolt does not simply slip out, hold gun grip in right hand and gently slap end of front of barrel with left hand palm, then remove bolt. Make sure bolt release (located above the magazine release button of pistol) is down.

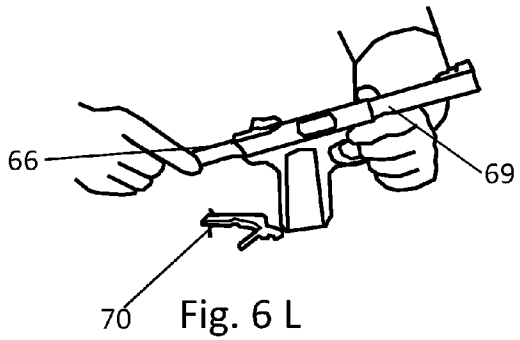

Fig. 6 L

Step 8 - 99

Removing grips from barrel: Place bolt opening end of barrel onto table. Tilt pistol back so that only the top edge of the barrel is resting on the table. Let barrel rest on thumbs. Place slot opening of tool over the trigger guard. With both hands, press tool down applying slight pressure until the grips frame releases off of the barrel.

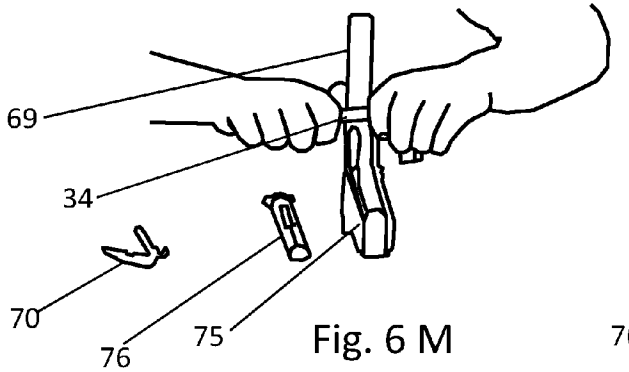

Fig. 6 M

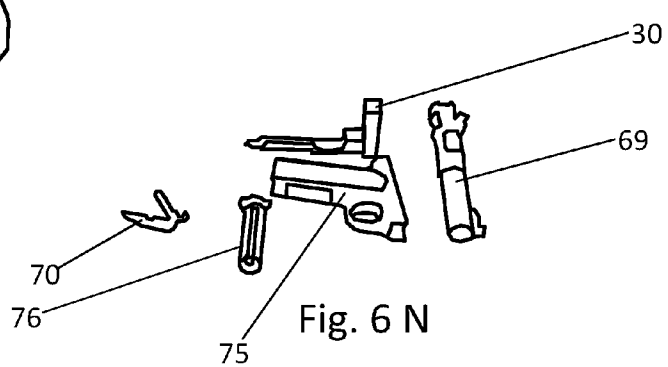

Fig. 6 N

Step 9 - 100

Remove spring assembly from bolt: Insert dowel of tool into the hole and gently pry spring up; it will be under little pressure and will lift up and out easily. Also, lift up half disc, of spring assembly, out of slot on the bolt.

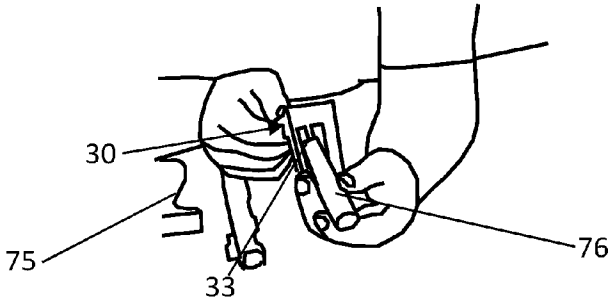

Fig. 6 O

One is now ready to clean one's gun

Assembling the gun. 120

Step 1 - 121

Replacing spring assembly onto bolt: Place flat side of half disc back into slot. Line up fork side of spring assembly over the hole in bolt and press fully down. Insert dowel of tool in hole to ensure fork of spring is lined up over hole in bolt. Keep thumb over spring while removing the tool to ensure fork of spring assemble remains lined up.

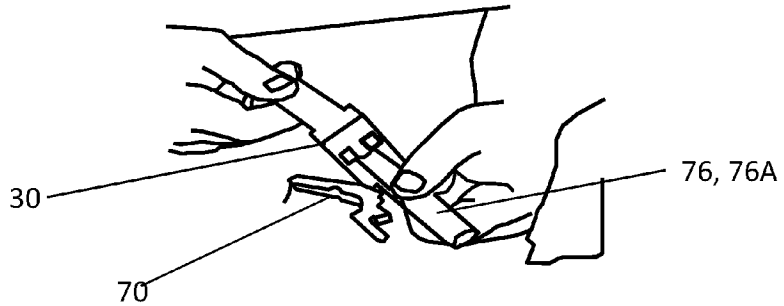

Fig. 7 A

Step 2 - 122

Replace handle back onto barrel: Place front site of barrel onto table. Line up rectangle opening of barrel over silver rectangle block in gun handle. Sandwich the handle and the barrel together and then press down on grips frame until handle slides down in barrel, opening. About 1/16 of inch of the barrel will overlap the handle. It is important to keep muzzle, or front site of barrel pointed down and preferably on the table throughout all the steps; until step 8.

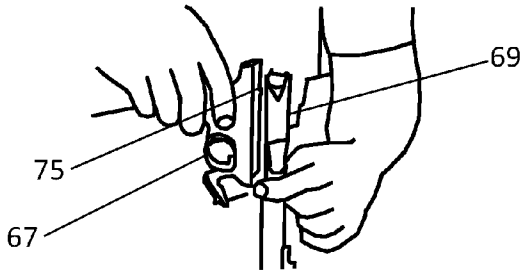

Fig. 7 B

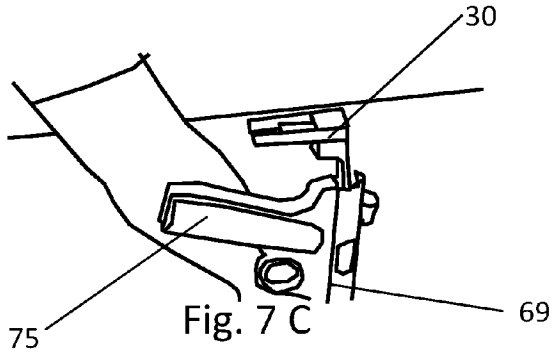

Fig. 7 C

Step 3 - 123

Resetting hammer: Insert key of tool into the bolt opening of barrel. Guides of tool will be parallel to and above grips frame. Insert tool fully in until it comes to stops of tool, a few twists on tool may be required. The hammer in of pistol is now reset. Remove tool.

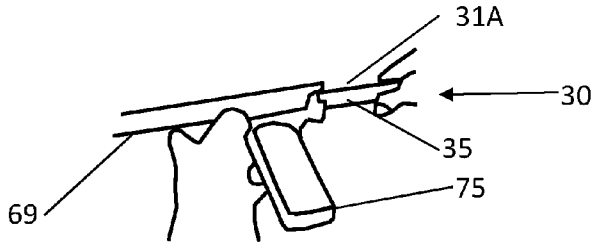

Fig. 7 D

Step 4 - 124

Replacing bolt: Insert bolt assembly back into the barrel. Check to make sure bolt release button is pressed down away from bolt, if not down bolt will not fully go in. Looking through the hole in the barrel, behind the rear site, see the spring centered in hole as the bolt slides down into barrel. If bolt stops before fully in, pull back ¼ of inch and twist bolt slightly left right, for better alignment and slide bolt fully in. Finish inserting bolt into barrel ensuring that the hole on the bolt lines up with hole in barrel. The fork on the spring will appear to be in the way.

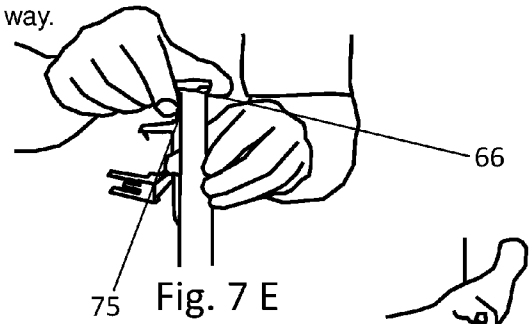

Fig. 7 E

Step 5 - 125

Replace magazine/clip into gun: Keep front site of barrel onto table. Hold bolt fully down with fingers while inserting clip, to keep bolt in place. Make sure the magazine clicks to ensure it is fully locked in. A magazine that is not locked in or a bolt not fully down will cause a mainspring jam.

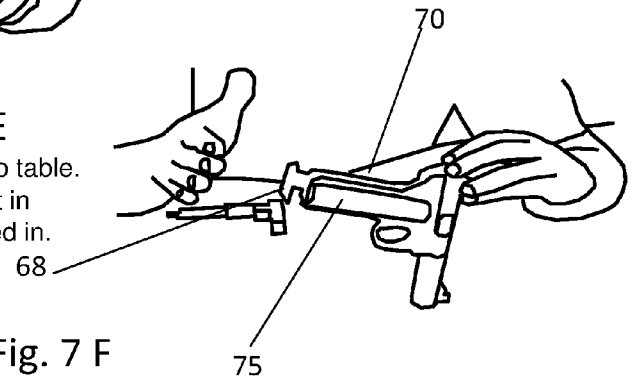

Fig. 7 F

Step 6 - 126

Replacing main spring pin: Keep front site of barrel onto table. Place hook of mainspring assembly into slot groove in between grips. Move the mainspring assembly towards barrel. Line up pin with barrel and bolt hole, press pin into hole, at least 2/3 of the way, or until it comfortably stops. Make sure pin is in the hole not below the hole! Most pins will need pressure from the tool to be fully pressed in. This is the next step.

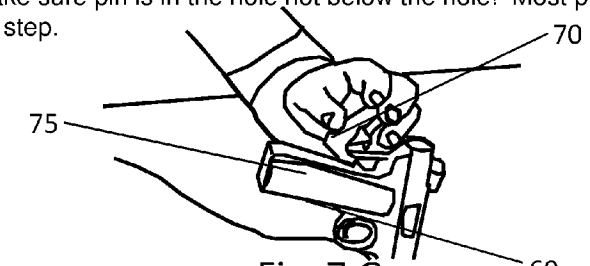

Fig. 7 G

Step 7 - 127

Finishing pin: Leaving front site of barrel on table, turn the pistol away from you. Place slot opening of tool over the grove between grips. Line up edge of tool with small rivet in mainspring. Using both hands on tool with thumbs on barrel and site; apply pressure by squeezing tool towards pistol bolt, finishing pressing pin in. If pin does not press in make sure bolt is fully in.

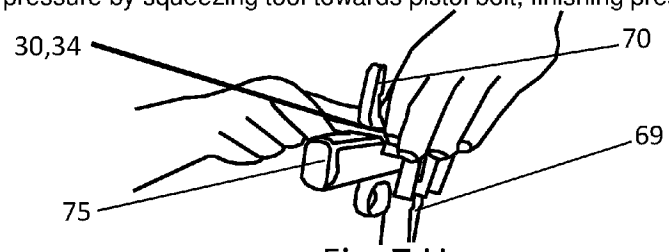

Fig. 7 H

Step 8 - 128

Fully Pulling and holding trigger: (Make sure latch of mainspring is open.) With pistol barrel still pointed down, fully pull and hold trigger. While holding trigger, turn pistol up pointing toward ceiling. Do not release trigger!

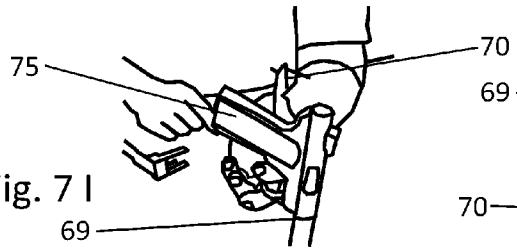

Fig. 7 I

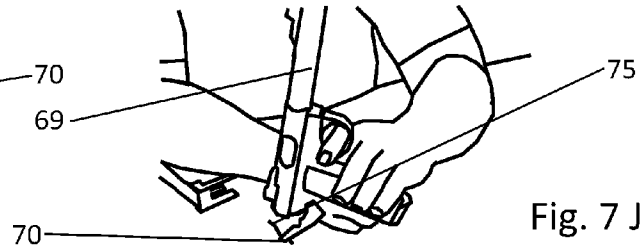

Fig. 7 J

Step 9 - 129

Finishing mainspring: While keeping pistol pointed up and holding the trigger, put mainspring body fully into grove between grips, while leaving latch open. (Caution if mainspring pin, behind rear site, is pulling out while putting mainspring body in or is stiff to put in DO NOT latch. Return to step 5 and remove and reinsert magazine, then step 7, 8 and 9.) Final step, press latch of mainspring assembly snapping it into place. Release trigger.

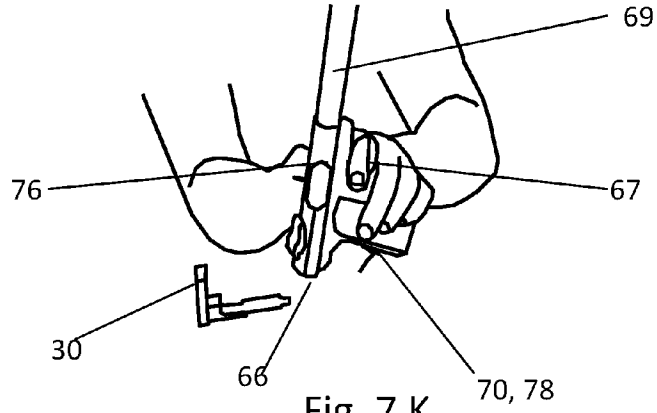

Fig. 7 K

Step 10 – 130

Check pistol: Dry fire pistol (no ammunition) in a safe direction and one is ready to enjoy the pistol again.

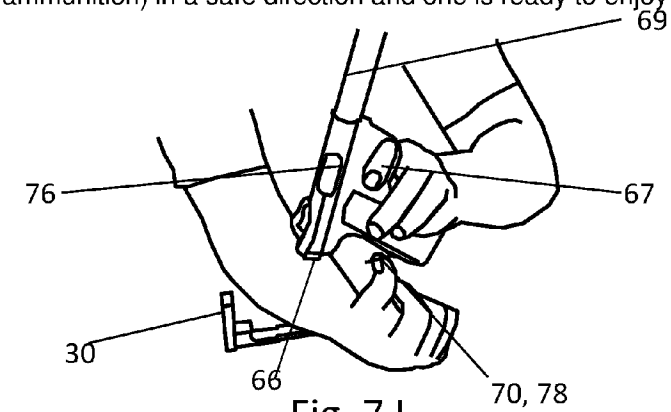

Fig. 7 L

Magazine loader

Step 9 - 131

Line up magazine/ clip on tool: Hold tool with dowel away from ones body. Place magazine flat onto the block lining up magazine to pass between dowel and right side guide. Magazine slide will catch right guide. (not dowel, or left guide)

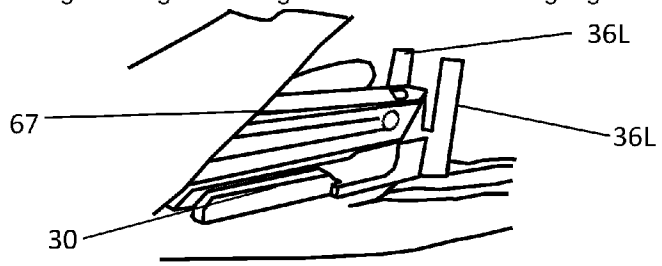

Fig. 8 A

Step 2 - 132

Press Magazine Forward: Place palm of hand on base of magazine and index finger on top of magazine. Press forward and slightly down, ensuring the magazine stays as flat as possible against the block of the tool. Move magazine forward until slide is fully depressed.

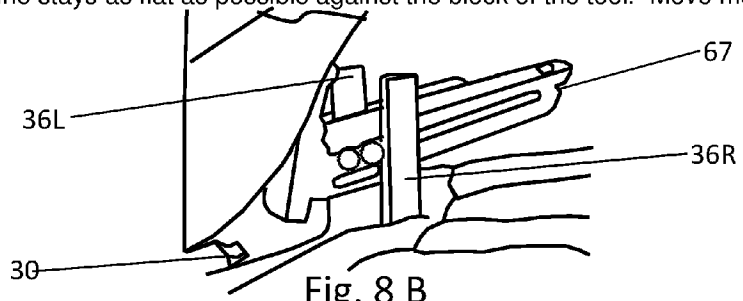

Fig. 8 B

Step 3 - 133

Load: <u>Caution</u>: slide spring will be under pressure. Always grip magazine with hand while loading. Wrap index finger around front of clip and put other fingers under base of magazine. After finishing loading, simply pull magazine out.

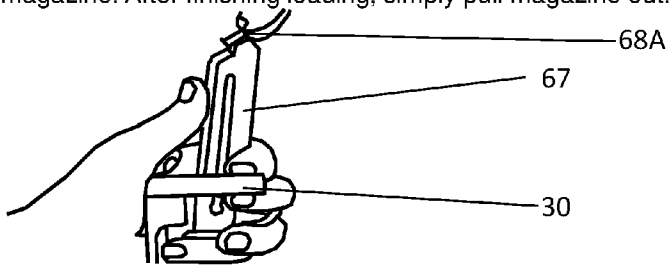

Fig. 8 C

All Prior Art

SPECIAL TOOL DEVICE FOR EASY DISASSEMBLY AND REASSEMBLY FOR CLEANING AN AUTOMATIC PISTOL SUCH AS A RUGER

CROSS-REFERENCE TO RELATED APPLICATIONS

This application claims the benefit of U.S. Provisional Patent Application with Ser. No. 61/900,524 filed Nov. 6, 2013 by Steve Wilkinson and entitled "A special tool device for easy disassembly and reassembly for cleaning a Ruger".

FIELD OF INVENTION

This invention relates to a special tool device for easy cleaning of an automatic Pistol such as a Ruger Mark Series or equal. The present disclosure relates generally to a system and tools for disassembling and reassembling firearm components including removing a mainspring assembly, bolt, spring assembly, barrel and grips, for firearms such as a Ruger Mark Series and other automatic weapons and handguns. This is useful for cleaning, inspection and replacement of parts for handguns.

FEDERALLY SPONSORED RESEARCH

None.

SEQUENCE LISTING OR PROGRAM

None.

BACKGROUND—FIELD OF INVENTION AND PRIOR ART

A. Background:

Handgun safety is very important and is an ongoing concern in today's society. Routine maintenance of the handgun is a considerable factor in contributing to handgun safety. Accordingly, the periodic inspection and cleaning of the handgun is an absolute necessity. To accomplish this the handgun must be disassembled. Therefore, it is often necessary to disassemble and clean firearms and, in particular, pistols. Of course one must have the proper tools to disassemble the handgun.

Pistols, because of their relatively small size, are often carried on a person or in a small carrying case. When being carried on a person or in the field, it is often necessary to also carry different accessories or tools for the pistol. Most pistols are designed to be partially disassembled in the field should they malfunction or require cleaning. To more completely disassemble most firearms, and in particular pistols, a punch and hammer are often required to be used. However, a punch is relatively difficult or inconvenient to carry and may be lost, misplaced, or forgotten. Accordingly, it is often difficult to fully disassemble a firearm as might be required in the field for cleaning or repair. It may be desirable to disassemble, repair, or clean a pistol in the field, and depending upon the circumstances, it may be necessary to disassemble, repair, or clean a pistol quickly without the ability to seek additional tools or assistance. Therefore, there is a need for a simple and easy to use tool that is always accessible and easily stored, and particularly when the pistol or firearm is in the field.

B. Problem Addressed:

There presently exists a genuine need for a better tool for disassembly and reassembly of automatic pistols/handguns such as the Mark Series Ruger and others. Routine maintenance of automatic handguns such as the Ruger Mark Series pistol can be somewhat cumbersome and difficult because the tools available to disassemble the handgun are not the most desirable. In order to disassemble the handgun the mainspring and barrel assembly must be removed from the frame of the gun. Therefore a simple, durable apparatus to readily and easily facilitate this process is desirable.

C. Prior Art:

FIGS. 9 and 10 are prior art kits and devices and are examples of more expensive and more complicated prior art devices. Here are shown in FIG. 9, prior art cleaning kit—with many tools and bulky size and configurations; a prior art plastic coated hammer; and a prior art rubber mallet for disassembly. FIG. 10 then demonstrates a gun tool prior art U.S. Pat. No. US Des 548,552 issued to Elkaim (2007) showing a "Gun Accessory Tool"; a disassembly tool in prior art U.S. Pat. No. 6,230,430 issued to Gosselin (2001) showing a "Gun Tool"; and a disassembly and bore kit in prior art U.S. Pat. No. 7,664,529 issued to Hopper et al. (2010) showing a "Rifle Bolt Cleaning Tool". None anticipate the special tool device for easy disassembly and reassembly for cleaning a Ruger shown with the present invention. As far as known, there are no devices such as the present special tool device for easy cleaning of an automatic Pistol such as a Ruger Mark Series or equal It is believed that this product is unique in its design and technologies.

SUMMARY OF THE INVENTION

The present invention is a tool for use in disassembling and reassembling a firearm, and in particular a pistol, that may be stored in a case or carried with the user of the pistol. The preferred embodiment of the device is: an improved one piece handgun disassembly and reassembling tool made of a durable material and configured for use with a handgun, the tool having a guide rod/rib with a key and an aperture, the rib having an angled section for the reassembly; an angle ended, reassembly notch contiguous to the rib and relatively thicker than the rib; an open slot interposed between the rib and reassembly notch and a block, the slot for reassembly of a barrel and a grip; the block with a flat side opposite the slot; and a dowel pin connected at one end to the block and having an angled top and a starter for a ball pin on another, opposite end of the block wherein the tool is used with the handgun such as a Ruger Mark Series or equal for disassembly and reassembly of the handgun.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

Objects and Advantages

The Advantages and Benefits of the special tool device for easy disassembly and reassembly for cleaning a Ruger include, for example, but are not limited to:

| Item | Advantages |
|---|---|
| 1 | Is a small size for easy carrying in a case or by a person |
| 2 | Permits the disassembly and reassembly without a plethora of small tools and bulky punches and hammers |
| 3 | Features for use built into the one-piece device |
| 4 | Is made of durable yet non-marring material |

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

DESCRIPTION OF THE DRAWINGS

Figures

The accompanying drawings, which are incorporated in and constitute a part of this specification, illustrate an embodiment of a special tool device for easy disassembly and reassembly for cleaning a Ruger Mark Series that is preferred. The drawings together with the summary description given above and a detailed description given below serve to explain the principles of a special tool device for easy disassembly and reassembly for cleaning a Ruger. It is understood, however, that the special tool device for easy disassembly and reassembly for cleaning a Ruger is not limited to only the precise arrangements and instrumentalities shown.

FIG. 7 A through 7 L are sketches showing the steps in re-assembling the Ruger pistol.

FIGS. 8 A through 8 C are sketches showing the steps in loading a clip/magazine with the device.

DESCRIPTION OF THE DRAWINGS

REFERENCE NUMERALS

Figure 1A:
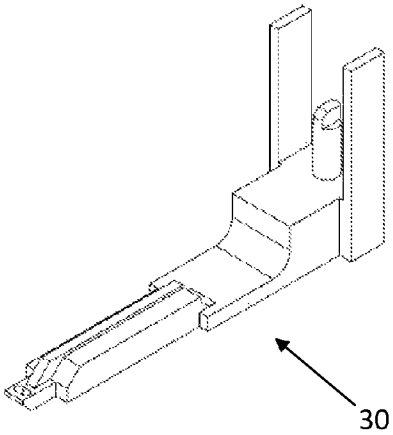
FIGS. 1 A through 1 D are various sketches of the tool, the parts of a Ruger, the tool in use with disassembling the Ruger, and the instruction methods.
Figure 1B:
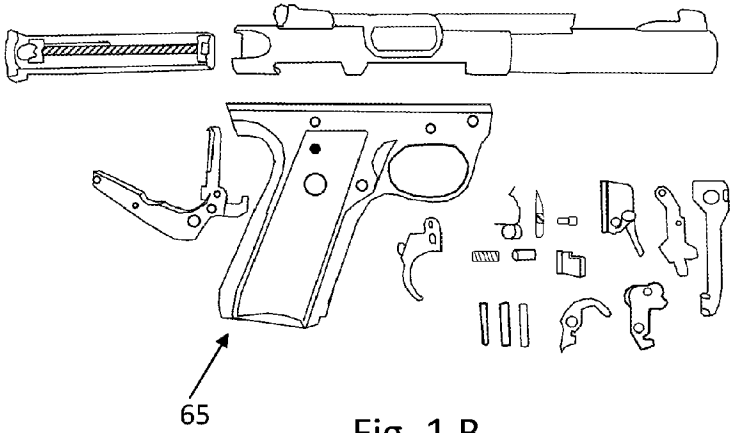
Figure 1C:
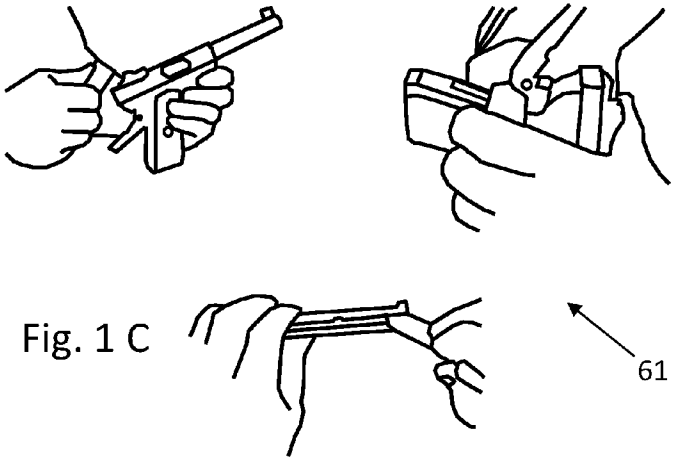
Figure 1D:
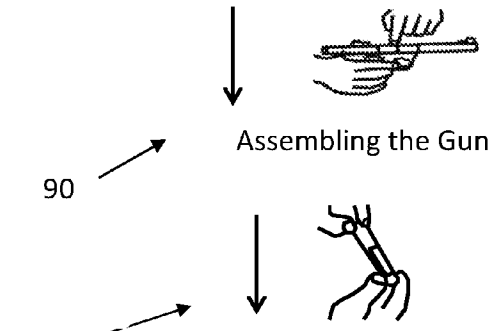
Figure 2D:
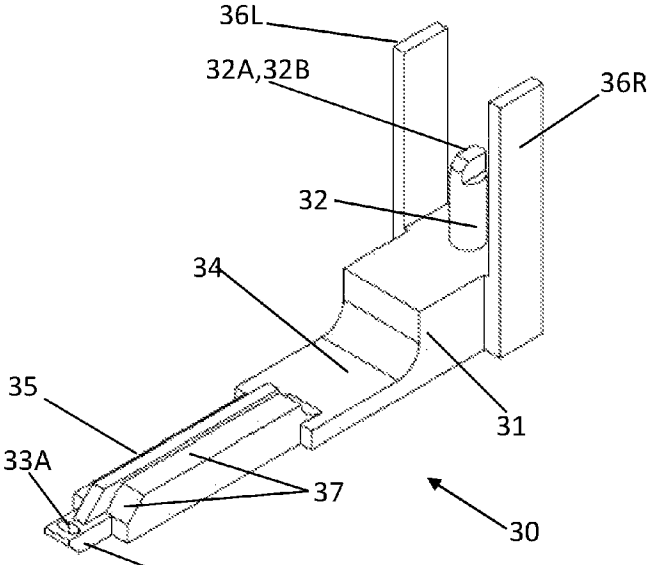
FIGS. 2 A through 2 D are the full sketches of the special tool device for easy disassembly and reassembly for cleaning a Ruger.
Figure 2C:
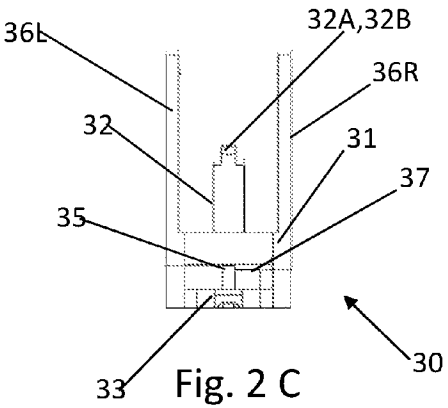
Figure 2A:
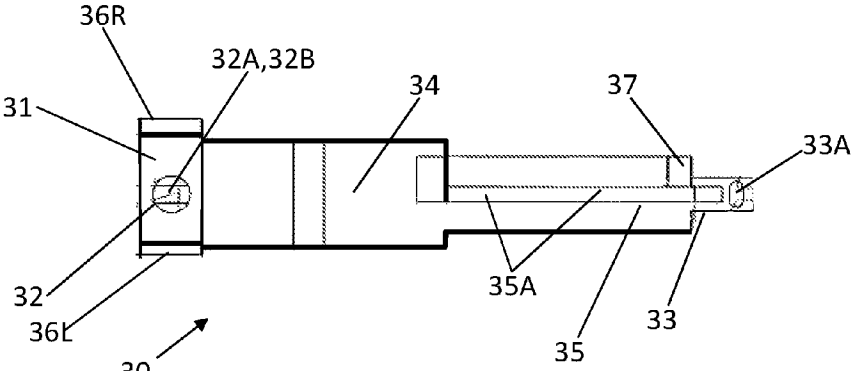
Figure 2B:
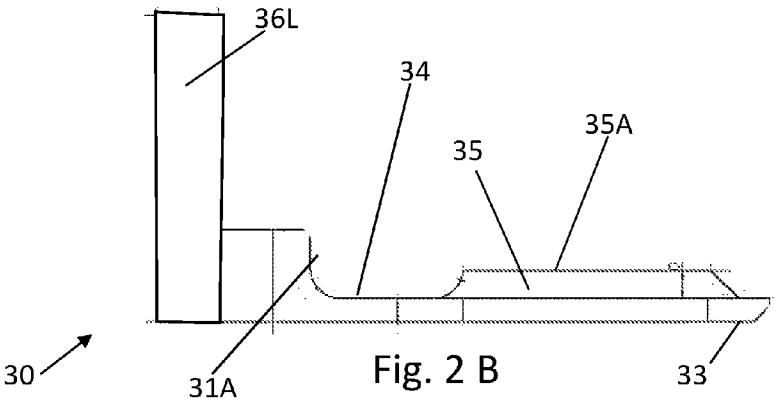

The following list refers to the drawings:

TABLE A

Reference numbers

| Ref # | Description |
|---|---|
| 30 | A special tool device for easy disassembly and reassembly for cleaning a Mark Series Ruger |
| 31 | Block |
| 31A | Flat side of tool and block, opposite the slot 34 |
| 32 | Dowel pin |
| 32A | Dowel pin angle - approximately 45 degrees |
| 32B | Ball starter feature |
| 33 | Key |
| 33A | Key aperture, hole, slot or equivalent |
| 34 | Slot |
| 35 | Rib |
| 35A | Angle on rib - approximately 10 degrees with block base as zero point |
| 36L | Left guide |
| 36R | Right guide |
| 37 | Reassemble notch - thickened and relatively shorter than rib 35 |
| 60 | Person disassembling and cleaning the Ruger |
| 61 | Details of Ruger pistol 65 with tool device 30 |
| 62 | Optional soft support for disassembly |
| 63 | Preferred hands free stand for support |
| 65 | Ruger Mark Series |
| 66 | Bolt |
| 67 | Trigger |
| 68 | Clip for cartridges/bullets 68A |
| 68A | cartridges/bullets |
| 69 | Barrel of pistol |
| 70 | Mainspring assembly |
| 71 | Mainspring pin |
| 72 | Mainspring latch |
| 73 | Pin aperture/hole |
| 74 | Dimple at mainspring 70 |
| 75 | Gun grip |
| 76 | Spring assembly |
| 76A | Spring |
| 77 | Hole/aperture in spring assembly |
| 78 | Groove in gun grip 75 for mainspring assembly 70 |
| 80 | prior art cleaning kit - many tools |
| 81 | prior art plastic coated hammer or the like |
| 82 | prior art rubber mallet for disassembly |
| 83 | prior art US Patent US Des 548.552 |
| 84 | prior art U.S. Pat. No. 6,230,430 |
| 85 | prior art U.S. Pat. No. 7,664,529 |
| 90 | Steps for Disassembly |
| 91 | Step 1 - Open bolt safety check |
| 92 | Step 2 - Dry fire gun |
| 93 | Step 3 - Remove clip |
| 94 | Step 4 - Insert key into groove |
| 95 | Step 5 - Open mainspring latch |
| 97 | Step 6 - Remove mainspring |
| 98 | Step 7 - Pull bolt out of gun |
| 99 | Step 8 - Remove gun grip from barrel |
| 100 | Step 9 - Remove spring assembly from bolt |
| 120 | Steps for Re-assembly |
| 121 | Step 1 - Replace spring assembly onto bolt |
| 122 | Step 2 - Replace barrel back onto grip |
| 123 | Step 3 - Reset block and trigger |
| 124 | Step 4 - Replace bolt |
| 125 | Step 5 - Replace clip into gun |
| 126 | Step 6 - Replace mainspring pin |
| 127 | Step 7 - Finish pin |
| 128 | Step 8 - Pull and hold trigger |
| 129 | Step 9 - Latch mainspring |
| 130 | Step 10 - Gun check |
| 131 | Step 1 - Line up magazine 68 on tool 30 |
| 132 | Step 2 - press magazine 68 forward |
| 133 | Step 3 - load magazine 68 with cartridges 68A |
| 140 | Steps for loading the cartridges into the magazine/clip |

DETAILED DESCRIPTION OF PREFERRED EMBODIMENT

The present development is a special Ruger tool device for easy cleaning. This invention relates to a special tool device for easy cleaning of a Ruger Mark Series or equal. The present disclosure relates generally to a system and tools for disassembling and reassembling firearm components including removing a mainspring assembly, bolt, spring assembly, barrel and grips, for firearms such as a Ruger Mark Series and other weapons and handguns. This is useful for cleaning, inspection and replacement of parts for handguns.

The special tool device 30 for easy disassembly and reassembly for cleaning a Ruger has several advantages and benefits. The Advantages and Benefits of the special tool device for easy disassembly and reassembly for cleaning a Ruger include, for example, but are not limited to:

1. Is a small size for easy carrying in a case or by a person;
2. Permits the disassembly and reassembly without a plethora of small tools and bulky punches and hammers;
3. Features for use built into the one-piece device; and
4. Is made of durable yet non-marring material.

The preferred embodiment of the device is: an improved one piece handgun disassembly tool 30 made of a durable material and configured for use with a handgun 65, the tool 30 having a guide rod/rib 35 with a key 33 and an aperture 33A, the rib 35 having an angled section 35A for the reassembly; an angle ended, reassembly notch 37 contiguous to the rib 35 and relatively thicker than the rib 35; an open slot 34 interposed between the rib 35 and reassembly notch 37 and a block 31, the slot 34 for reassembly of a barrel 69 and a grip 75; the block 31 with a flat side 31A opposite the slot 34; and a dowel pin 32 connected at one end to the block 31 and having an angled top 32A and a starter 32B for a ball pin 71 on another, opposite end of the block 31 wherein the tool 30 is used with the handgun 65 such as a Ruger Mark Series or equal for disassembly and reassembly of the handgun 65.

The accompanying drawings, which are incorporated in and constitute a part of this specification, illustrate an embodiment of the special tool device 30 for easy disassembly and reassembly for cleaning a Ruger 65 that is preferred. The drawings together with the summary description given above and a detailed description given below serve to explain the principles of device 30 for a gun 65.

Figures 9, 9A, 9B, 9C:
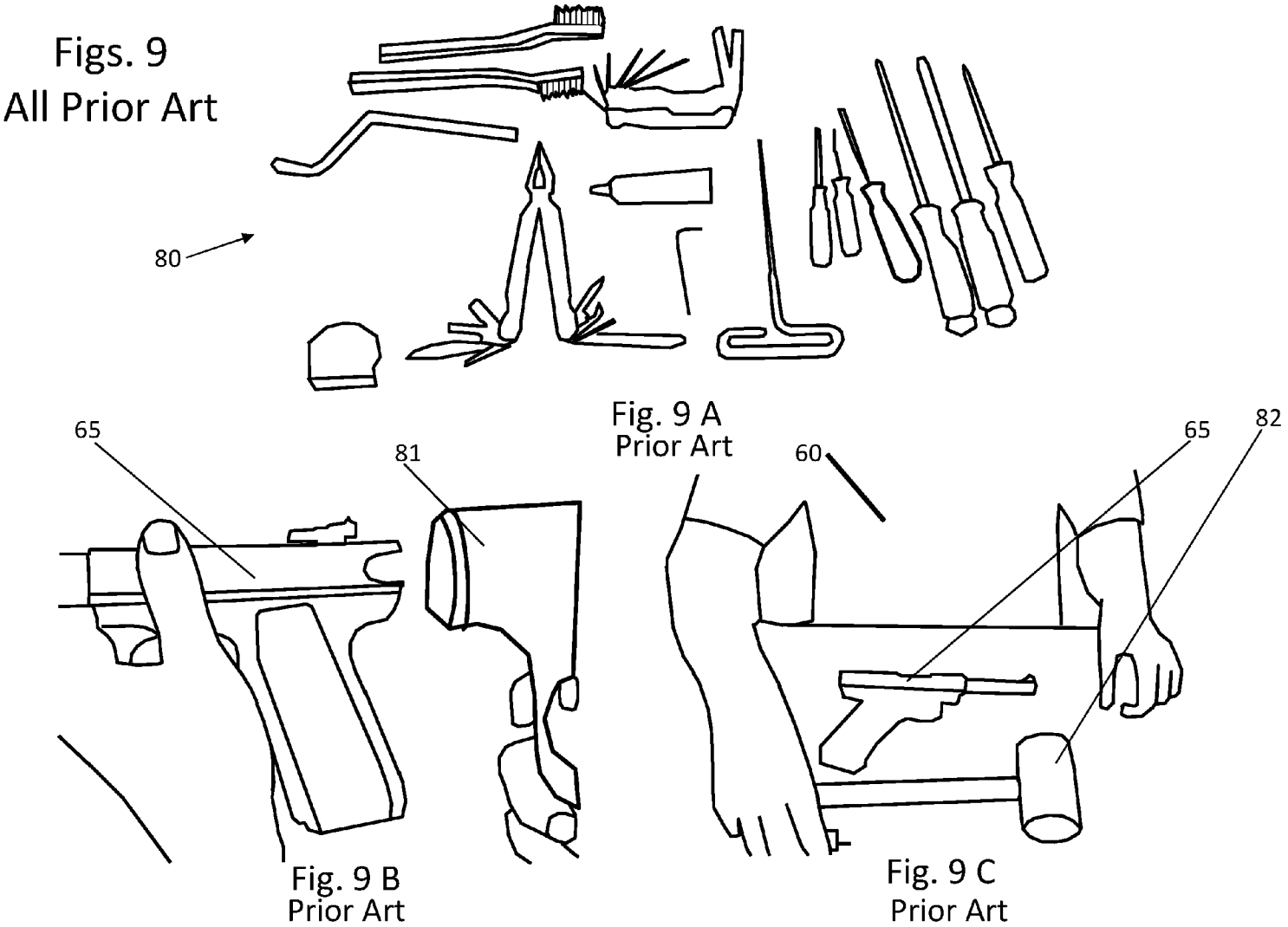
Fig. 9 A Prior Art
Fig. 9 B Prior Art
Fig. 9 C Prior Art
FIGS. 9 A through 9 C are prior art kits and devices.

There is shown in FIGS. 1-9 a description and operative embodiment of the special tool device 30 for easy disassembly and reassembly for cleaning a Ruger. In the drawings and illustrations, one notes well that the FIGS. 1-5 demonstrate the general configuration, and FIGS. 6 and 7 show examples but not limitations of the uses in the operation and use section, below. FIG. 8 and FIG. 9 are examples of prior art.

FIGS. 1 A through 1 D are various sketches of the tool 30, the parts of a Ruger 65, a preview of sketches 61 of the tool 30 in use with disassembling the Ruger 61, and the instruction methods for disassembly 60 and reassembly 120.

FIGS. 2 A through 2 D are the full sketches of the special tool device 30 for easy disassembly and reassembly for cleaning a Ruger 65. FIG. 2 A is a Top View, FIG. 2 B is a Side View, FIG. 2 C is an End View and FIG. 2 D is an isometric of the tool 30. The various components and features are clearly labeled and comprise: block 31; flat side 31A of tool 30 and block 31, opposite the slot 34; a dowel pin 32 with a dowel pin angle 32A—approximately 45 degrees and a ball starter feature 32B; a key 33 with a key aperture, hole, slot or equivalent 33A; a slot 34; a rib 35 with an angle 34A on rib 34—the angle being approximately 10 degrees with block base 31A as zero point; a reassemble notch 37—thickened and relatively shorter than rib 35 and a pair of left guides 36L and right guides 36R. The special tool device 30 for easy disassembly and reassembly is anticipated to be made of a durable, non-marring composite material or plastic. For example, a Delrin® or nylon. Other materials—such as aluminum, steel alloy, and strong pressed fiber composite materials may be useable upon testing and confirmation or with an appropriate non-marring coating or dip.

Figure 3:
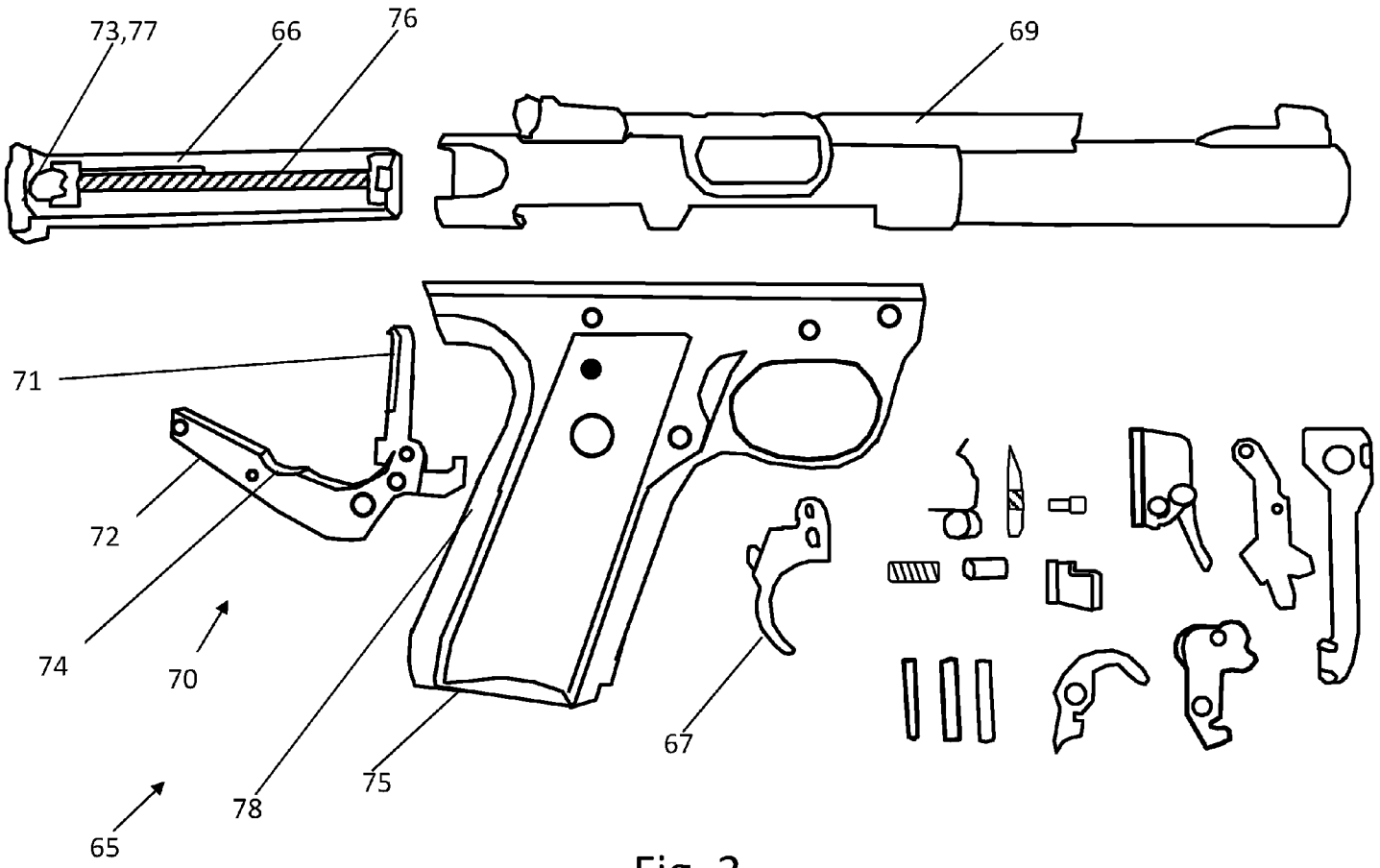
FIG. 3 is a demonstration of the parts of a Ruger.

FIG. 3 is a demonstration of the parts of a Ruger 65. Portrayed here are: a Ruger Mark Series gun 65; a bolt 66; a trigger 67; a clip 68 for cartridges/bullets 68; a barrel 69 of pistol 65; a mainspring assembly 70; a mainspring pin 71; a mainspring latch 72; a pin aperture/hole 73; a dimple at mainspring 74; gun grip(s) 75; spring assembly 76 and spring 76A; a hole/aperture in spring assembly 77; and a groove 78 in gun grip 75 for mainspring assembly 70.

Figures 4A, 4B, 4C, 4D, 4E, 4F:
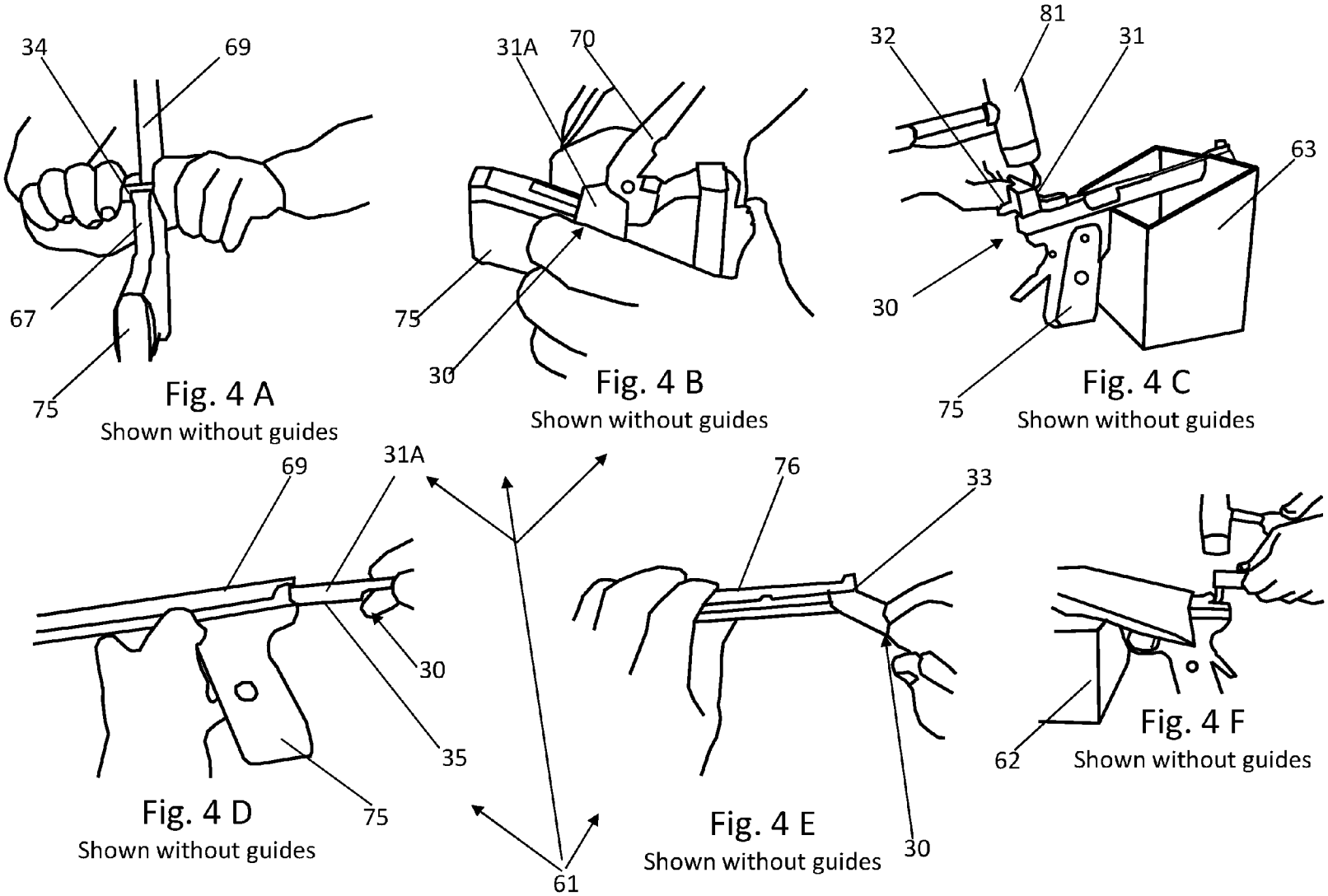
FIG. 4 A through FIG. 4 F are sketches of the tool in use with disassembling the Ruger.
Figure 5A:
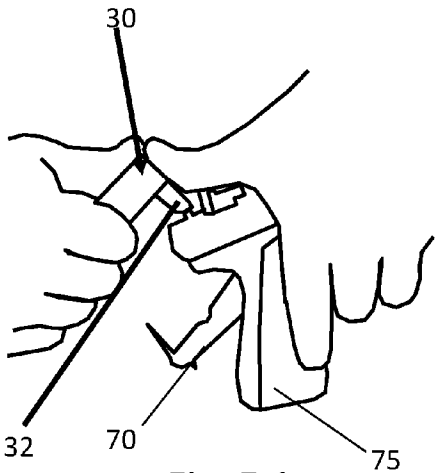
FIG. 5 A through 5 E show additional sketches of the tool in use with disassembling the Ruger.
Figure 5B:
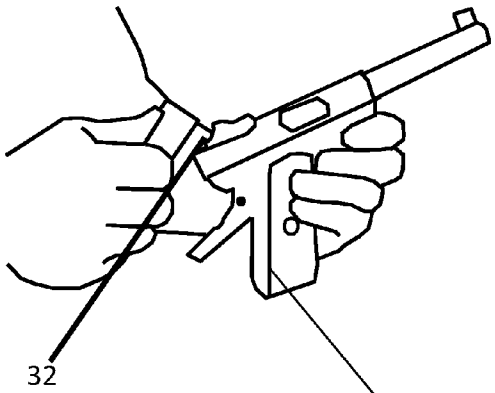
Figure 5C:
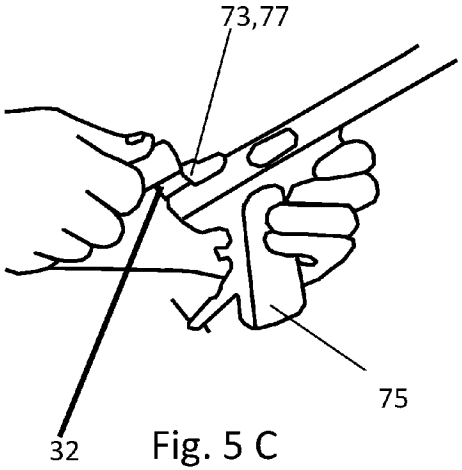
Figure 5D:
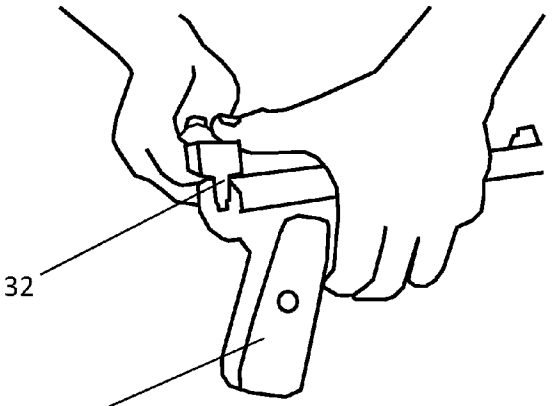
Figure 5E:
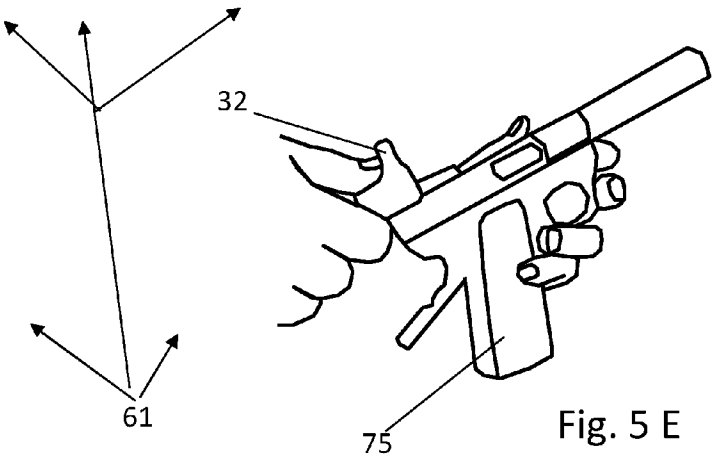

FIG. 4 A through FIG. 4 F are sketches 61 of the tool 30 in use with disassembling the Ruger 65. In these figures are the disassembly/reassembly tool 30 with its features working on different components of the Ruger 65. Included are: features of the tool 30—block 31; flat side 31A of tool 30 and block 31, opposite the slot 34; a dowel pin 32 with a dowel pin angle 32A; a key 33; a slot 34; and a rib 35 with an angle 34A on rib 34—the angle being approximately 10 degrees with block base 31A as zero point; and features of the Ruger 65—a Ruger Mark Series gun 65; a barrel 69 of pistol 65; a mainspring assembly 70; gun grip(s) 75; and a spring assembly 76 and spring 76A. Also shown in FIG. 4 C is a preferred hands free support stand 63 for disassembly and in FIG. 4 F an alternative soft support shown 62. The hands free stand 63 is anticipated to be made of composite pressed fiber, cardboard or a composite material.

FIG. 5 A through 5 E show additional sketches 61 of the tool 30 in use with disassembling the Ruger 65. In these figures are the disassembly/reassembly tool 30 with its features working on different components of the Ruger 65. Included are: features of the tool 30—block 31; and a dowel pin 32 with a dowel pin angle 32A—approximately 45 degrees; and features of the Ruger 65—a mainspring assembly 70; a pin aperture/hole 73; gun grip(s) 75; and a hole/aperture in spring assembly 77.

FIGS. 6 and 7 are sketches showing the steps in disassembling the Ruger pistol and in re-assembling the Ruger pistol. These are described in the operation section, below.

Figure 10A:
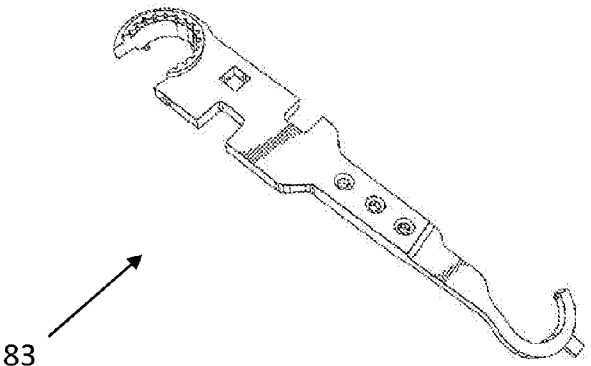
Fig. 10 A Prior Art
FIGS. 10 A through 10 C are prior art kits and devices.
Figure 10B:
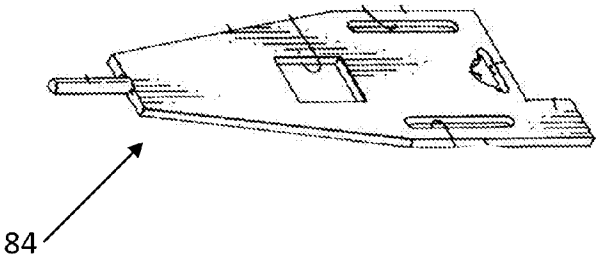
Fig. 10 B Prior Art
Figure 10C:
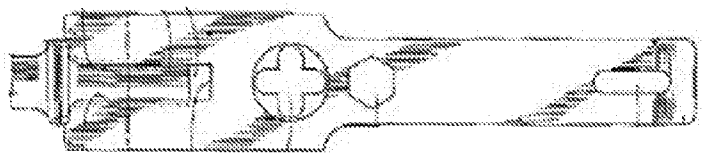
Fig. 10 C Prior Art

FIGS. 9 A through 9 C and FIGS. 10 A through 10 C are prior art kits and devices and are examples of more expensive and more complicated prior art devices. Here are shown in FIG. 8, prior art cleaning kit 80—with many tools and bulky size and configurations; a prior art plastic coated hammer 81 or the like; and a prior art rubber mallet 82 for disassembly. FIG. 9 then demonstrates a gun tool prior art U.S. Pat. No. Des 548,552—83; a disassembly tool in prior art U.S. Pat. No. 6,230,430—84; and a disassembly and bore kit in prior art U.S. Pat. No. 7,664,529—85. None anticipate the special tool device for easy disassembly and reassembly for cleaning a Ruger shown with the present invention.

The details mentioned here are exemplary and not limiting. Other specific components and manners specific to describing a special tool device 30 for easy disassembly and reassembly for cleaning a Ruger 65 may be added as a person having ordinary skill in the field of gun disassembling and reassembling accessories and devices and their uses well appreciates.

Operation of the Preferred Embodiment

The special tool device 30 for easy disassembly and reassembly for cleaning of a Ruger has been described in the above embodiment. The manner of how the device operates is described below. This invention relates to a special tool device for easy cleaning a Ruger Mark Series or equal. The present disclosure relates generally to a system and tools for disassembling and reassembling firearm components including removing a mainspring assembly, bolt, spring assembly, barrel and grips, for firearms such as a Ruger Mark Series and other weapons and handguns. This is useful for cleaning, inspection and replacement of parts for handguns. The preferred embodiment of the device is: an improved one piece handgun disassembly tool 30 made of a durable material and configured for use with a handgun 65, the tool 30 having a guide rod/rib 35 with a key 33 and an aperture 33A, the rib 35 having an angled section 35A for the reassembly; an angle ended, reassembly notch 37 contiguous to the rib 35 and relatively thicker than the rib 35; an open slot 34 interposed between the rib 35 and reassembly notch 37 and a block 31, the slot 34 for reassembly of a barrel 69 and a grip 75; the block 31 with a flat side 31A opposite the slot 34; and a dowel pin 32 connected at one end to the block 31 and having an angled top 32A and a starter 32B for a ball pin 71 on another, opposite end of the block 31 wherein the tool 30 is used with the handgun 65 such as a Ruger Mark Series or equal for disassembly and reassembly of the handgun 65.

The instructions for disassembling 90 and reassembling 120 the Mark Series Pistol 75 with all in-one-tool 30 are shown below. It is important for one to read the instructions carefully and then look at each referenced figure before attempting each step. Getting a step wrong or not putting the gun in a certain position can cause the gun to be jammed.

FIG. 6 A through 6 O are sketches showing the steps in disassembling the Ruger pistol. Other automatic pistols are very similar. The instructions for disassembling and assembling the Mark Series Pistol with all in-one-tool are: It is important to read the instructions carefully and then look at each sketch before attempting each step. Getting a step wrong or not putting the gun in a certain position can cause the gun to be jammed. Safety is always the first priority. No ammunition should be in the firearm or at the work area. The stand, included in the kit option, will free the second hand making the process safer and easier for new pistol owners.

Figure 6D:
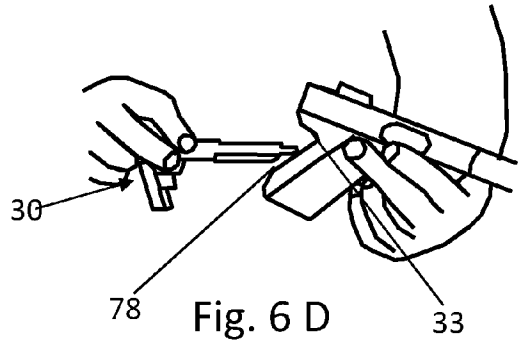
FIG. 6 A through 6 O are sketches showing the steps in disassembling the Ruger pistol.
Figure 6E:
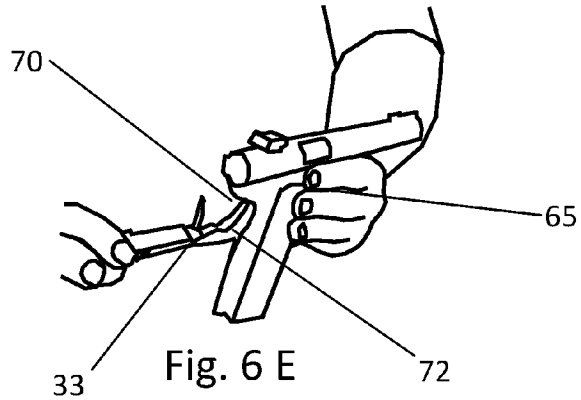

| Disassembling the gun - 90 | |
|---|---|
| Step 1 - 91 | Open bolt 66 safety check: Do safety check to ensure no ammunition is in the Gun 65. Furthermore, make sure ammunition is not in ones work area. Refer to FIG. 6A. |
| Step 2 - 92 | Dry fire Pistol 65: Point gun 65 in a safe direction and pull the trigger 67, dry firing the gun. Make sure pistol is un-cocked before proceeding to step 3. Refer to FIG. 6B. |
| Step 3 - 93 | Remove clip/magazine 68: Drop clip 68 from pistol 65. Refer to FIG. 6C. |
| Step 4 - 94 | Inserting key 33 into groove 78: Insert key 33 and key hole point 33A of tool 30 into the top of the groove 78 in mainspring 70 slot in the pistol grips frame 75, over latch 72 of mainspring 70. The tool will be at a downward angle. Press key. Refer to FIG. 6D. |
| Step 5 - 95 | Open mainspring 70 latch 72: Pull tool 30 in a downward direction inserting key hole 33A though latch 72. This will pull the mainspring 70 latch 72 out. Make sure latch 72 is fully open or mainspring body 70 will stick in groove 78. Refer to FIG. 6E. |
| Step 6 - 97 | Removing the mainspring pin assembly: The mainspring pin 71 is located directly behind the rear site of the pistol 65. See Option A) new or excessively dirty guns. Option B) broken in guns. Option A) New guns: For new or excessively dirty pistols 65 it may be required to use both hands to start pin 71, located behind rear site. Put pistol 65 in the stand 63 to free second hand FIG. 6F, to put more pressure on the tool 30. (Two options see FIG. 6G and 6H). Either use the approximately 45 degree angle 32A on the dowel 32 or the block 31 of the tool 30 to start the mainspring pin 71 out, FIG. 6G. In extreme cases, a few light taps with a hammer onto the block 31 of the tool 30 may be needed to start pin 71 removal, use FIG. 6H to set block 31 over pin 71, if hammering is required. Once the pin 71 is started line dowel 32 of tool 30 straight over pin 71, one can also use two hands, or a hammer, to press the mainspring 70 pin 71 fully out, by pressing the dowel 32 of the tool 30 through the hole in the gun barrel. (In the fourth sketch FIG. 6I below one can see the round dowel pin 71 of the mainspring 70 lying on the table.) If after dowel 32 of tool 30 is fully in, and mainspring 70 is not out totally, remove by hand. Option B) Broken in or used pistols 65: Once the pistol has been disassembled a few times it is easier to take apart, unless one allows the pistol 65 to become extremely dirty. If the firearm 65 is excessively dirty, use above option A with stand 63. Now one pries the dowel 32 to pry pin 71 out: Place the 45 degree angle 32A of the end of the dowel pin 32 of the tool 30 over top of the dimple of the mainspring 70 pin 71. Then pry like a can opener down until the mainspring 70 pin 71 is pushed below surface of barrel 69. Next line dowel 32 of tool 30 straight over mainspring 70 pin 71. Then push mainspring 70 pin 71 out. If dowel 32 of tool 30 is fully in and mainspring 70 pin 71 did not completely come out, remove by hand. Refer to FIGS. 6F through 6K. |
| Step 7 - 98 | Pull bolt 66 out of gun 65: If bolt 66 does not simply slip out, hold gun grip 75 in right hand and gently slap end of front of barrel 69 with left hand palm, then remove bolt 66. Make sure bolt release (located above the magazine release button of pistol) is down. Refer to FIG. 6L. |
| Step 8 - 99 | Removing grips 75 from barrel 69: Place bolt 66 opening end of barrel 69 onto table. Tilt pistol 65 back so that only the top edge of the barrel 69 is resting on the table. Let barrel rest on thumbs. Place slot opening of tool 30 over the trigger guard 67. With both hands, press tool 30 down applying slight pressure until the grips 75 frame releases off of the barrel 69. Refer to FIGS. 6M and 6N. |
| Step 9 - 100 | Remove spring assembly 76 from bolt 66: Insert dowel 32 of tool 30 into the hole and gently pry spring 76A up; it will be under little pressure and will lift up and out easily. Also, lift up half disc, of spring assembly 76, out of slot on the bolt 66. Refer to FIG. 6O. |

Now one is ready to clean and inspect the gun 65 and its components.

FIG. 7 A through 7 L are sketches showing the steps in re-assembling the Ruger pistol. Other automatic pistols are very similar.

| Assembling the gun. 120 | |
|---|---|
| Step 1 - 121 | Replacing spring assembly 76 onto bolt 66: Place flat side of half disc back into slot. Line up fork side of spring assembly 76 over the hole in bolt 66 and press fully down. Insert dowel 32 of tool 30 in hole to ensure fork of spring is lined up over hole in bolt. Keep thumb over spring while removing the tool to ensure fork of spring assemble remains lined up. Refer to FIG. 7A. |
| Step 2 - 122 | Replace handle grip 75 back onto barrel 69: Place front site of barrel 69onto table. Line up rectangle opening of barrel over silver rectangle block in gun handle 75. Sandwich the handle 75 and the barrel 69 together and then press down on grips |

-continued

| Assembling the gun. 120 | |
|---|---|
| | frame 75 until handle slides down in barrel, opening. About 1/16 of inch of the barrel 69 will overlap the handle 75. It is important to keep muzzle, or front site of barrel 69 pointed down and preferably on the table throughout all the steps; until step 8. Refer to FIGS. 7B and 7C. |
| Step 3 - 123 | Resetting hammer 67: Insert key 33 of tool 30 into the bolt 66 opening of barrel. Guides 36L, 36R of tool 30 will be parallel to and above grips frame 75. Insert tool 30 fully in until it comes to stops of tool 30, a few minor twists on tool 30 may be required. The hammer 67 in of pistol 65 is now reset. Remove tool 30. Refer to FIG. 7D. |
| Step 4 - 124 | Replacing bolt 66: Insert bolt 66 assembly back into the barrel 69. Check to make sure bolt 66 release button is pressed down away from bolt 66, if not down bolt 66 will not fully go in. Looking through the hole 77 in the barrel 69, behind the rear site, see the spring centered in hole as the bolt 66 slides down into barrel 69. If bolt 66 stops before fully in, pull back 1/4 of inch and twist bolt 66 slightly left and right, for better alignment and slide bolt 66 is fully inserted. Finish inserting bolt 66 into barrel 69 ensuring that the hole on the bolt lines up with hole in barrel. The fork on the spring will appear to be in the way. Refer to FIG. 7E. |
| Step 5 - 125 | Replace magazine/clip 68 into gun 65: Keep front site of barrel 69 onto table. Hold bolt 66 fully down with fingers while inserting clip 68, to keep bolt 66 in place. Make sure the magazine 68 clicks to ensure it is fully locked in. A magazine 68 that is not locked in or a bolt 66 not fully down will cause a mainspring 70 jam. Refer to FIG. 7F. |
| Step 6 - 126 | Replacing main spring 70 pin 71: Keep front site of barrel 69 onto table. Place hook of mainspring assembly 70 into slot groove/dimple 74 in between grips 75. Move the mainspring assembly 70 towards barrel 69. Line up pin 71 with barrel 69 and bolt hole 74, press pin 71 into hole 74, at least approximately 2/3 of the way, or until it comfortably stops. Make sure pin 71 is in the hole 74 not below the hole 74! Most pins 71 will need some pressure from the tool 30 to be fully pressed in. This is the next step. Refer to FIGS. 7G. |
| Step 7 - 127 | Finishing pin 71: Leaving front site of barrel 69 on table, turn the pistol 65 away from person. Place slot opening 34 of tool 30 over the grove 74 between grips 75. Line up edge of tool 30 with small rivet in mainspring 70. Using both hands on tool with thumbs on barrel 69 and site; apply pressure by squeezing tool 30 towards pistol bolt 66, finishing pressing pin 71 in. If pin 71 does not press in make sure bolt 66 is fully inserted. Refer to FIG. 7H. |
| Step 8 - 128 | Fully Pulling and holding trigger 67: (Make sure latch 72 of mainspring 70 is open.) With pistol 65 barrel 69 still pointed down, fully pull and hold trigger 67. While holding trigger 67, turn pistol 65 up pointing toward ceiling. Do not release trigger 67! Refer to FIGS. 7I and 7J. |
| Step 9 - 129 | Finishing mainspring 70: While keeping pistol 65 pointed up and holding the trigger 67, put mainspring 70 body fully into groove 74 between grips 75, while leaving latch 72 open. (Caution if mainspring 70 pin 71, behind rear site, is pulling out while putting mainspring body 70 in or is stiff to put in DO NOT latch. Return to step 5 and remove and reinsert magazine, then step 6, 7, 8 and 9.) Final step, press latch 72 of mainspring assembly 70 snapping it into place. Release trigger 67. Refer to FIG. 7K. |
| Step 10 - 130 | Check pistol 65: Dry fire pistol 65 (no ammunition) in a safe direction and one is ready to enjoy the pistol 65 again. Refer to FIG. 7L. |

FIGS. 8 A through 8 C are sketches showing the steps in loading a clip/magazine 68 with the device 30. The steps loading with the device 30 are shown in the FIGS. 8 A through 8 C and explained in the table below:

| Loading the magazine of the gun - 140 | |
|---|---|
| Step 1 - 131 | Line up magazine/clip 68 on tool 30: Hold tool 30 with dowel 32 away from one's body. Place magazine 68 flat onto the block 31 lining up magazine 68 to pass between dowel 35 and right side guide 36R. Magazine slide will catch right guide 36R. (not dowel 32, or left guide 36L). Refer to FIG. 8A. |
| Step 2 - 132 | Press Magazine 68 Forward: Place palm of hand on base of magazine 68 and index finger on top of magazine 68. Press forward and slightly down, ensuring the magazine 68 stays as flat as possible against the block 31 of the tool 30. Move magazine 68 forward until slide is fully depressed. Refer to FIG. 8B. |
| Step 3 - 133 | Load: Caution: slide spring of magazine 68 will be under pressure. Always grip magazine 68 with hand while loading. Wrap index finger around front of clip 68 and put other fingers under base of magazine 68. After finishing loading cartridges 68A, simply pull magazine 68 out. Refer to FIG. 8C. |

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible.

Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

With this description it is to be understood that the special tool device 30 for easy disassembly and reassembly for cleaning a Ruger is not to be limited to only the disclosed embodiment of product. The features of the special tool device 30 for easy disassembly and reassembly for cleaning a Ruger are intended to cover various modifications and equivalent arrangements included within the spirit and scope of the description. The present disclosure includes that contained in the appended claims, as well as that of the foregoing description. Although this invention has been described in its preferred form with a certain degrees of particularity, it is understood that the present disclosure of the preferred form has been made only by way of example and that numerous changes in the details of construction and the combination and arrangements of parts may be resorted to without departing from the spirit of the invention.

The invention claimed is:

1. An improved one piece disassembly tool, for an automatic handgun, the tool made of a durable, non-marring material and configured for use with a handgun, the tool comprised of:

(a) an elongated tool body having on one end portion a guide rod rib with a key configured to fit in the groove of the mainspring slot of the handgun and an aperture configured to pull out the mainspring latch of the handgun;

(b) the guide rod rib having an angled section for reassembling the handgun; an angle ended reassembly notch contiguous to the rod/rib and being relatively thicker than the rod/rib;

(c) the elongated tool body further comprising, an open slot interposed between the rib and the reassembly notch and a block located on an opposite end portion of the elongated tool body, the open slot configured for reassembly of a barrel and a grip of the automatic handgun; and (d) the block having a flat side extending opposite the slot and a perpendicular dowel pin configured to fit inside the barrel of the handgun connected at one end to the block, the dowel pin having an angled top and a starter for a ball pin of the handgun wherein the tool is used with the automatic handgun for disassembly and reassembly of the handgun.

2. The tool in claim 1 further comprised of a pair of guides.

3. The tool in claim 2 wherein the automatic handgun is a Ruger.

4. The tool in claim 1 wherein the tool is further used for loading a magazine/clip of the automatic handgun.

5. The tool in claim 1 wherein the tool is made of a durable nonmarring material selected from the group consisting of a composite material; plastic; aluminum, steel alloy, and strong pressed fiber composite materials.

6. An improved one piece disassembly tool, for a Ruger automatic handgun, the tool made of a durable, non-marring material and configured for use with a handgun, the tool comprised of:

(a) an elongated tool body having a guide rod/rib with a key configured to fit in the groove of the mainspring slot of the handgun and an aperture configured to pull out the mainspring latch of the handgun;

(b) the guide rod/rib having an angled section for reassembling the handgun; and angle ended, reassembly notch contagious to the rod/rib and being relatively thicker than the rib;

(c) the elongated tool body further comprising an open slot interposed between the rib and the reassembly notch and a block, the open slot for reassembly of a barrel and a grip of the automatic handgun;

(d) the block with a flat side extending opposite the slot and a perpendicular dowel pin configured to fit inside the barrel of the handgun connected at one end to the block and having an angled top and a starter for a ball pin of the handgun; and (e) a pair of guides around the dowel pin, wherein the tool is used with the automatic Ruger handgun for disassembly and reassembly of the handgun and loading of the magazine/clip.

7. A method for disassembling an automatic handgun comprised of the following steps:

A Step 1: Opening the bolt safety check of the handgun;

A Step 2: Dry firing the handgun;

A Step 3: Removing the clip/magazine from the handgun;

A Step 4: Using the disassembly tool of claim 1 to insert the key into the groove of the handgun's mainspring slot:

A Step 5:Opening the mainspring latch of the handgun using the aperture of the elongated tool of claim 1;

A Step 6: Removing the mainspring pin assembly;

A Step 7: Pulling bolt out of gun;

A Step 8: Removing grips from barrel; and

A Step 9: Removing spring assembly from bolt.

* * * * *